United States Patent [19]

Miraldi

[11] 4,125,980

[45] Nov. 21, 1978

[54] FOUNDATION, METHOD OF CONSTRUCTING SAME AND PARTS USEABLE THEREIN

[76] Inventor: Robert V. Miraldi, 240 Gregory Ct., Moorestown, N.J. 08057

[21] Appl. No.: 755,732

[22] Filed: Dec. 30, 1976

[51] Int. Cl.[2] ..... E02D 27/00

[52] U.S. Cl. ..... 52/293; 52/169.9; 52/294; 52/309.12; 52/437; 249/19

[58] Field of Search ..... 52/327, 743, 747, 169.1, 52/169.7, 169.8, 169.9, 292–296, 437, 299, 405, 438, 439, 744, 309.12, 259, 274, 440, 328; 249/13, 48, 18, 49, 17, 50, 26, DIG. 2, 51, 207, 33, 210, 34; 264/31, 35

[56] References Cited

U.S. PATENT DOCUMENTS

| | | | |
|---|---|---|---|
| 1,399,751 | 12/1921 | Denniston | 249/26 |
| 1,500,121 | 7/1924 | Fontaine | 249/19 |
| 1,661,739 | 3/1928 | Sentrop | 52/440 |
| 1,947,413 | 2/1934 | Hay | 249/48 |
| 1,982,217 | 11/1934 | Luehrs | 52/259 |
| 2,043,697 | 6/1936 | Deichmann | 52/259 |
| 2,208,589 | 7/1940 | Leemhuis | 52/274 |
| 2,425,883 | 8/1947 | Jackson | 52/309.17 |
| 2,483,080 | 9/1949 | Wilson | 52/295 |
| 2,526,066 | 10/1950 | Croce | 52/454 |
| 3,024,512 | 3/1962 | Dyer | 249/51 |
| 3,148,494 | 9/1964 | Stark | 249/DIG. 2 |
| 3,195,312 | 7/1965 | Rumsey | 52/169.1 |
| 3,260,493 | 7/1966 | Beckham | 249/48 |
| 3,295,278 | 1/1967 | Muhm | 52/309.12 |
| 3,438,161 | 4/1969 | Koch | 52/309.12 |
| 3,653,629 | 4/1972 | Keyston | 249/19 |
| 3,693,308 | 9/1972 | Trezzini | 52/259 |
| 3,857,540 | 12/1974 | Ecker | 264/31 |
| 4,015,383 | 4/1977 | Crowley | 52/259 |

FOREIGN PATENT DOCUMENTS

| | | | |
|---|---|---|---|
| 686,389 | 7/1930 | France | 52/440 |

*Primary Examiner*—John E. Murtagh
*Attorney, Agent, or Firm*—John W. Logan, Jr.

[57] ABSTRACT

A foundation for pre-engineered buildings in accordance with a preferred embodiment of the invention disclosed herein includes concrete footings provided at spaced-apart locations along the perimeter of the building to be erected. Light weight precast reinforced concrete grade beams are set in place with the end of each beam bearing on adjacent footings. Adjacent ends of grade beams extending in a straight line relative to each other are formed with channel configurations forming a keyway and adjacent ends of grade beams extending at a right angle to each other are formed with an interlocking configuration. One of these latter grade beams is formed with a keyway adjacent its interlocking configuration and its associated footing. A light weight disposable form is secured to the top of each footing and is generally U-shaped in plan view including a pair of parallel side walls and a connecting wall. The free ends of the parallel side walls are secured to opposite sides of the keyways and an anchor bolt is suspended in a yoke from the top of the form so that a portion of the bolt extends above the form. A concrete pier is poured in each form whereby the wet concrete flows into the keyways and hardens to secure the grade beams in place.

27 Claims, 6 Drawing Figures

FIG. 1.
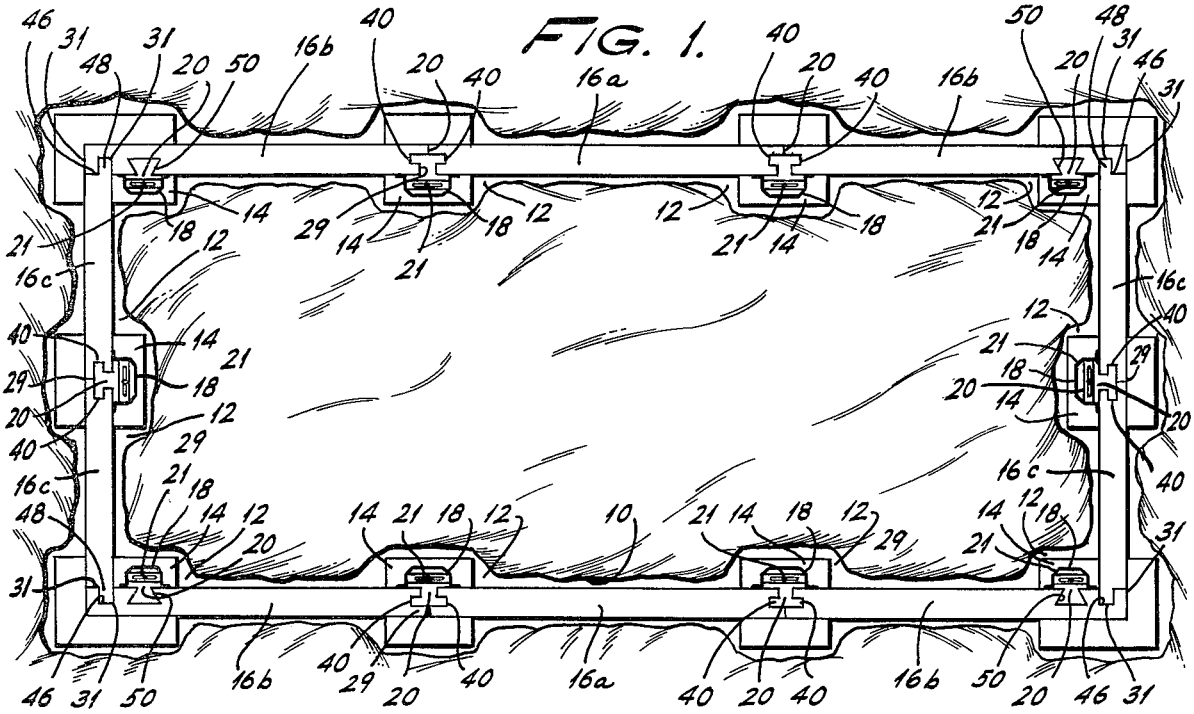
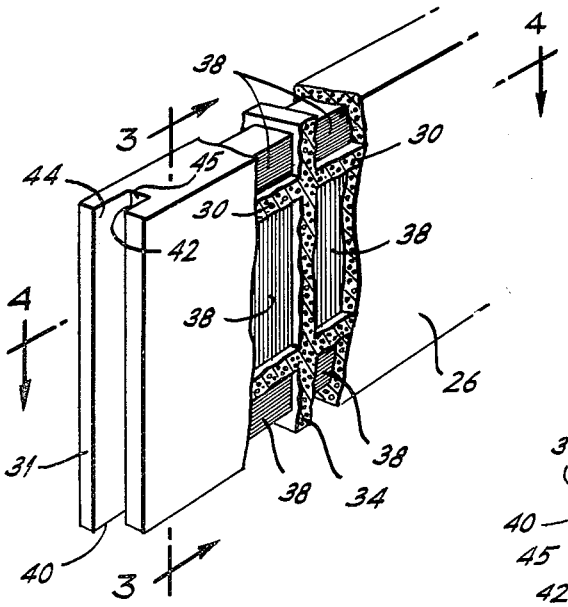
FIG. 2.
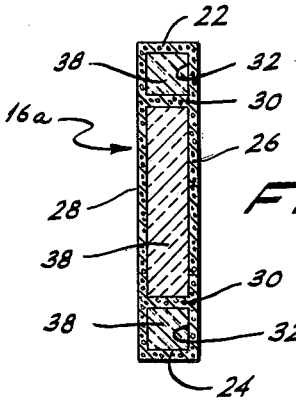
FIG. 3.
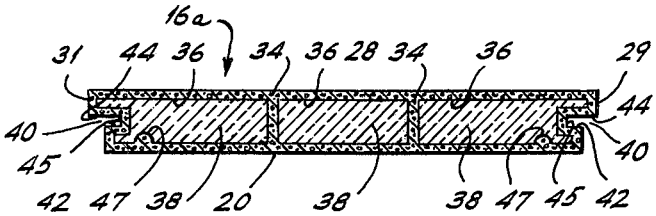
FIG. 4.

FOUNDATION, METHOD OF CONSTRUCTING SAME AND PARTS USEABLE THEREIN

This invention relates to building foundations and, more particularly, to foundations for pre-engineering buildings, a method of constructing such foundations and parts usable therein.

When constructing pre-engineered buildings it has been usual to provide a foundation in accordance with generally conventional building techniques. For example, concrete foundation walls have been poured around the perimeter of the building to be erected; concrete block walls have been constructed on poured concrete footings around the perimeter of the building to be erected; and conventional reinforced precast concrete walls have been placed around the perimeter of the building to be erected. Pouring concrete foundation walls and constructing concrete block walls require considerable manual labor and cannot be done in periods of cold or wet weather; utilizing conventional precast concrete walls requires the use of large cranes or other specialized equipment and a relatively large number of men to handle the equipment and the walls. Because of the considerable manual labor involved, the above-described techniques are relatively expensive and are not entirely satisfactory, particularly, for use with pre-engineered buildings. In addition, delays in constructing the foundation caused by inclement weather can add significantly to the cost of construction.

Accordingly, it is an object of the invention to provide a foundation and method of constructing same that utilizes a significant number of light weight pre-engineered parts.

It is another object of this invention to provide light weight precast reinforced concrete grade beams particularly useful in constructing a foundation for pre-engineered buildings.

It is yet another object of this invention to provide a form made of light weight disposable material particularly useful in constructing a foundation for pre-engineered buildings and a blank from which such a form can be provided.

Finally, it is an object of this invention to provide a foundation and method of constructing same utilizing light weight pre-engineered parts such that the method and the resultant foundation are relatively economical.

These and other objects of this invention are accomplished by providing concrete footings at spaced-apart locations along the perimeter of a building to be erected. After the footings have been provided, light weight precast reinforced concrete grade beams are set between adjacent footings with the ends of each beam bearing on adjacent footings. Light weight disposable forms, generally U-shaped in plan view are secured to the top surfaces of the footings and also to the grade beams so that the open sides of the forms are adjacent the grade beams. At this point a yoke is placed across the top of each form and at least one anchor bolt is suspended in each yoke such that a threaded portion of the anchor bolt extends upwardly above the top of the form. Thereafter, concrete is poured in the forms to provide concrete piers adjacent the grade beams which piers then secure the grade beams in place on the footings with the anchor bolts extending above the top of the piers. Thereafter, the building walls can be attached to the grade beams in any conventional manner and the framing for the building can be secured to the tops of the piers through the anchor bolts.

More particularly, adjacent ends of grade beams extending in a straight line relative to each other are formed with channel configurations such that a keyway is formed by these adjacent ends and adjacent ends of grade beams extending at right angles to each other are formed with an interlocking configuration. One of these beams extending at a right angle is formed with a keyway adjacent its interlocking configuration and its associated footing. Thus, when concrete is poured into the form it flows into the keyways to secure the grade beams to the piers and the footings.

Each grade beam comprises a closed generally hollow structure formed with exterior walls and with internal stiffener walls which form, with the exterior walls, a plurality of separate cavities within the hollow structure. The exterior walls and the internal stiffener walls are made of concrete, preferably reinforced with glass fibers, and the cavities are filled with light weight insulation material. Included among the exterior walls is a pair of end walls and at least one end wall of each grade beam is formed with the channel configuration. Certain of the grade beams are formed with a channel configuration in both end walls and certain other grade beams are formed with the interlocking configuration at the end opposite the channel configuration. Certain of these other grade beams are formed with the keyway adjacent its interlocking configuration.

The light weight forms for the concrete piers each comprise a first pair of parallel side walls which are connected to each other at one end by a connecting wall. Flaps extend outwardly from the other ends of the parallel walls and are used in securing the form to the grade beams. These flaps may be formed with openings for receiving fasteners used to secure the forms to the grade beams. Additional flaps extend outwardly from the lower end of the parallel walls and the connecting wall and are used in securing the forms to the top of the footings.

For a better understanding of the invention disclosed herein, reference is made to the following description of a preferred embodiment thereof taken in conjunction with the figures of the accompanying drawing in which:

FIG. 1 is a plan view of a foundation constructed in accordance with this invention;

FIG. 2 is a perspective view illustrating a grade beam in accordance with this invention with portions broken away to illustrate its internal construction;

Figure 5:
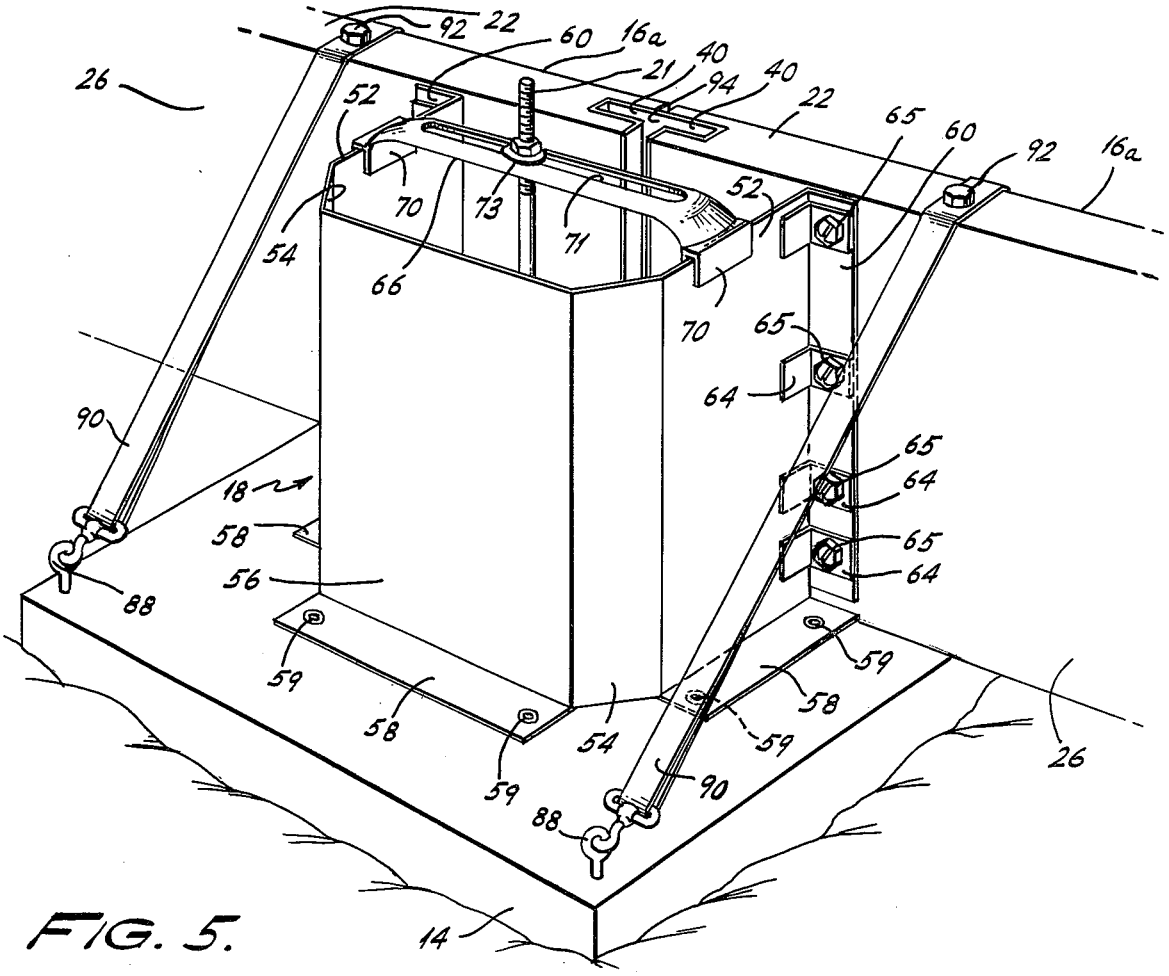
Figure 6:
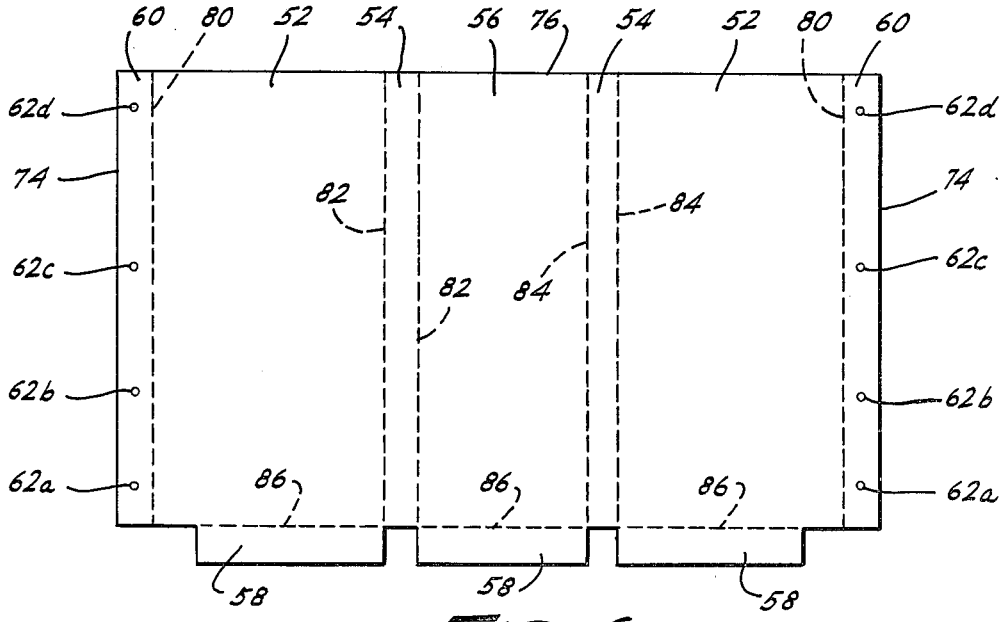

FIGS. 3 and 4 are sectional views of a grade beam in accordance with this invention taken generally along the lines 3—3 and 4—4, respectively, of FIG. 2;

FIG. 5 is a perspective view of the joints provided between adjacent grade beams extending in a straight line; and FIG. 6 is a plan view of a blank which can be used to provide forms in accordance with this invention.

Referring briefly to FIG. 1 of the drawing, there is illustrated, in plan view, a foundation prepared in accordance with this invention for supporting a pre-engineered metal building. The foundation is formed in a trench 10 defining a perimeter generally corresponding to the perimeter of the building to be erected and having a suitable depth, usually about 3 feet, throughout most of its perimeter. Since pre-engineered buildings are commonly rectangular in plan view, the preferred embodiment of the invention disclosed herein relates to constructing a foundation for a generally rectangular building and, thus, the perimeter defined by the trench is generally rectangular. At the intersection of each of its legs, the trench is formed with enlarged portions 12 of larger width and depth than the remainder of the trench so that concrete footings 14 can be formed in place with a top surface located a predetermined distance below the ground, usually about 3 feet. The enlarged portions 12 and footings 14 can also be located at spaced-apart locations between the ends of each leg of the trench 10, depending upon the distance spanned by that leg, to accomodate framing members for the building to be erected.

A plurality of light weight precast concrete grade beams, denoted generally by reference numeral 16, extend throughout the perimeter defined by the trench 10, and are arranged such that each end of a grade beam bears on the top surface of an adjacent footing 14. Certain of the grade beams 16 are located between adjacent footings such that its adjacent grade beams do not extend from a corner of the trench 10 and these beams will be referred to as intermediate beams **16*a*. Certain others of the grade beams 16 are located at a corner of the trench 10 such that adjacent beams extend at a right angle to each other and these beams will be referred to as corner beams 16*b* and 16*c*. Except for the configuration at one end, the beams 16*a*, 16*b* and 16*c* are generally the same. As will be made clear hereinafter, grade beams 16*a*, 16*b* and 16*c*** are utilized to support the side walls of the building to be erected and can also tie into a concrete floor to be formed within the perimeter defined by the grade beams.

Supported on the top surface of each footing 14 is a light weight generally disposable form 18 into which concrete is poured to provide a pier 20 which secures adjacent grade beams together and also secures the grade beams in place on the footings 14, as will be made clear hereinafter. In addition, piers 20 provide support for columns or other framing members (not illustrated) for the roof of the building to be erected and to this end, suitable anchor bolts 21 are secured in the piers 20 and extend above the top of the piers.

Having briefly described the foundation, reference is now made to FIGS. 2–4 of the drawing wherein the grade beam **16*a* is illustrated. It should be understood that the following description of the grade beam 16*a* is applicable to grade beams 16*b* and 16*c* unless otherwise noted. Each grade beam is a generally elongated hollow structure formed by a plurality of exterior walls including generally parallel top and bottom walls 22 and 24, respectively, generally parallel inner and outer walls 26 and 28, respectively, and a pair of end walls 29 and 31. The exterior walls are made of a hardened mixture of concrete reinforced with glass fiber rovings and have a thickness of about one-quarter of an inch. Spaced a short distance from the top and bottom walls 22 and 24, respectively, of each grade beam is a pair of generally horizontal stiffener walls 30,30 each defining with the adjacent top and bottom walls and with portions of the inner and outer walls 26 and 28, respectively, a pair of longitudinally extending cavities 32,32. At spaced-apart locations between the end walls 29 and 31 of each grade beam are generally vertical stiffener walls 34 which extend between the top wall 30 and the bottom wall 30 of each grade beam. The vertical stiffener walls 34 along with the horizontal stiffener walls 30,30 function to rigidify the beam structure and also define generally longitudinally extending central cavities. The stiffener walls also have a thickness of about one-quarter of an inch. From the preceding description it should be understood that the interior of the grade beams 16*a*, 16*b* and 16*c* may be considered to include a generally honey-comb type of structure so that the beams are of relatively light weight, but of sufficient rigidity to support the building walls. Located in the cavities 32,32 and 36 is a light weight insulation material 38**, for example, sheets of beaded polystyrene.

A typical grade beam has a height (distance between walls 22 and 24) of about 3 feet, a thickness (distance between walls 26 and 28) of about 3 inches and a length distance between walls 29 and 31) of any desired dimension up to about 25 feet. Obviously the drawing of the grade beam is exaggerated for the sake of clarity. In addition, the distance between horizontal stiffener walls 30 and their adjacent walls 22 and 24 is about two and one-half inches so that the distance between the horizontal stiffener walls is about 2¼ feet. Finally, the distance between vertical stiffener walls 34 is about 4 feet. The dimensions of the typical grade beam just described can vary depending on the particular concrete mix used and the application in which it is intended to be used.

As noted previously, the grade beams **16*a*, 16*b* and 16*c* are precast concrete structures reinforced with glass fiber rovings of relatively short lengths which can conveniently be mixed with the concrete when the grade beams are formed. For example, a wet concrete mixture can be sprayed toward the inside of a generally U-shaped form member through a spray nozzle arranged adjacent to a chopping gun which chops glass fiber strands into rovings of short lengths and injects the rovings into the stream of concrete as it is discharged from the spray nozzle. Thus, a mixture of concrete and glass fiber rovings is sprayed into the U-shaped form member. When the form member has been coated with about ¼ of an inch of the mixture, the spray is discontinued and the top wall 22, bottom wall 24, inner wall 26 and end walls 29 and 31 of the grade beams have been formed. The insulation material 38 can now be placed on the inner surface of the inner wall 28 in the general area where the cavities 32 and 36 are to be formed. Thereafter, the concrete and glass fiber rovings are again sprayed into the form member around the insulation material 38 forming the stiffener walls 32,32 and 34, the cavities 32 and 36 and the outer wall 28**. After the concrete mixture has set to a sufficient hardness, the grade beam is formed and can now be removed from the form member.

The end walls 29 and 31 of each grade beam are formed with a different configuration depending on whether the beam is an intermediate beam **16*a* or a corner beam 16*b* or 16*c*. The intermediate beams 16*a* are formed with channels 40,40 in each end wall 29 and 31 and each channel extends throughout the height of the beam, that is, from the top wall 22 to the bottom wall 24. Each channel 40 is generally U-shaped in plan view including a pair of parallel inner and outer walls 42 and 44, respectively, connected by a wall 45. The wall 44, adjacent the outer wall 28, is longer than the wall 42, adjacent the inner wall 26, that is, the wall 44 extends farther from the connecting wall 45 than the wall 42. Referring back to FIG. 1 of the drawing, it can be seen that one end wall 29 of each of the corner beams 16*b* and 16*c* is formed with a channel 40 similar to that described with respect to grade beam 16*a*. Still referring to FIG. 1 of the drawing it can be seen that when the grade beams are in place, the channels 40 in adjacent ends of beams extending in a straight line relative to each other define a keyway slot communicating through the inner walls 26 of the beams. At this point, it is merely noted that the inside surface of the inner walls 26 of the grade beams 16***a*, 16*b* and 16*c* are formed with a thickened rib 47 extending from the top wall 22 to the bottom wall 24 adjacent the channel 40. The function of the rib 47 will be made clear hereinafter.

The ends of the corner beams 16*b* and 16*c* opposite the end walls 29 formed with the channels 40 are formed with a configuration for interlocking the corner beams with each other. In the preferred embodiment of the invention disclosed herein, the interlocking configuration in beam 16*b* includes a U-shaped channel 46 formed in the inner wall 26 closely adjacent the end wall 31. In beam 16*c* the interlocking configuration includes a notch formed in the outer wall 28 and in the end wall 32 so that a projecting rib 48 is formed. The rib 48 is of a size to be received in the channel 46. Closely adjacent the channel 46, the inner wall 26 of the grade beam 16*b* is formed with a keyway slot 50 in the inside surface of the inner wall is formed with thickened ribs extending from the top wall 22 to the bottom wall 24 which ribs are similar to the rib 47 formed adjacent the channel 40.

Referring briefly to FIG. 5 of the drawing, the disposable form 18 in which the piers 20 are formed is illustrated. The form 18 is made of a relatively inexpensive, light weight, easy to manipulate material such as corrugated cardboard capable of withstanding stress of about 450 psi. In plan view the form 18 is generally U-shaped and includes a pair of generally parallel side walls 52, 52 connected to each other at one end by a wall structure including a pair of short walls 54,54 forming an obtuse angle with the side walls and with a longer wall 56 extending generally perpendicular to the side walls. The height of the form, that is the height of the side walls 52,52 and connecting walls 56 is generally equal to that of the grade beams, that is, is equal to the distance between the top and bottom walls 22 and 24, respectively, and at their lower ends each wall is connected to an outwardly extending rectangular flap 58. In use, the flaps 58,58,58 are arranged to seat on the top surface of a footing 14 and to be secured thereto by studs 59 driven through the flaps and into the footing. In addition, the unconnected ends of the side walls 52,52 are formed with generally rectangular bearing flaps 60,60 which flaps extend outwardly from the free ends of the side walls and bear on the inner surfaces 26,26 adjacent the channels 40,40 of adjacent grade beams extending in a straight line relative to each other or adjacent keyway 50. Each flap 60 is formed with a series of small openings 62*a*, 62*b*, 62*c* and 62*d* extending from adjacent the bottom of the flap and spaced apart by progressively increasing distances toward the top of the flap. That is, the distance between openings 62*a* and 62*b* is less than the distance between openings 62*b* and 62*c* which, in turn, is less than the distance between the openings 62*c* and 62*d*. In use, L-shaped metal washers 64 having an opening in one face are placed over the flap 60 such that the opening in a metal washer is aligned with an opening in the flap and such that one leg of the metal washer bears on the outer surface of the adjacent side wall 52. Thereafter, suitable fasteners 65 of the thread forming type are inserted through the aligned openings into the ribs 47 to secure the form 18 to the inner wall 26 of adjacent grade beams 16,16 or to opposite sides of the keyway 50 formed in grade beam 16*b*. Since wet concrete is poured into the form, the inner surfaces of side walls 52,52, short wall 54,54 and longer wall 56 are coated with wax or a similar moisture resistant material to resist the absorption of water into the cardboard. It can be seen that the variable spacing between the openings 62*a*, 62*b*, 62*c* and 62*d* provides greater support for the form 18 adjacent its bottom where the pressure of the wet concrete on the form is greatest.

In a typical installation the distance between parallel side walls 52,52 of the form 18 is about sixteen inches and the distance between the unconnected end of each side wall 52 and its adjacent short connecting wall 54 is about seventeen inches. The height of the form 18 corresponds to the height of the grade beams and in the embodiment of the invention disclosed herein is about three feet. The distance between openings 62*a*,62*a* and 62*b*,62*b* and 62*c*,62*c* and 62*d*,62*d* is such that when the form 18 is placed in position on the footings 14 the openings are aligned with the ribs 47 formed on the inside surface of inner walls 26 of the grade beams.

Referring to FIG. 6 of the drawing, a blank from which the form 18 can be provided is illustrated. The blank includes a generally rectangular central portion formed with side edges 74,74 a top edge 76 and a bottom edge 78. Closely adjacent each of the side edges 74 is formed score line 80 extending parallel to its adjacent side edge such that a flap 60 extends between each side edge and each score line. Formed between the score lines 80,80 are a first pair of score lines 82,82 closely adjacent each other and a second pair of score lines 84,84 also closely adjacent each other such that the area between the score lines 82,82 and the area between the score lines 84,84 forms the short connecting walls 54,54. The area between one score line 80 and the adjacent score line 82 forms one of the side walls 52 and the area between the other score line 80 and the adjacent score line 84 forms the other side wall 52. The area between adjacent score lines 82 and 84 forms the longer connecting wall 56. In addition, the rectangular flaps 58,58,58 extend from the lower edge 78 of the rectangular portion of the blank and score lines 86 are formed at the juncture of the lower edge 78 of the rectangular portion and the flaps 58. The openings 62*a*, 62*b*, 62*c* and 62*d* are formed between the first pair of score lines 80,80 and their respective side edges 74,74.

To assemble the form 18, the side edges 74,74 of the blank are grasped by hand and bent outwardly about the score lines 80,80 until the flaps 60,60 extend at a right angle to the rectangular portions of the blank. Similarly, the flaps 58,58,58 are grasped by hand and are bent outwardly about the score lines 86,86,86 until these flaps also extend a right angle to the rectangular portion of the blank. Now, the side walls 52,52 and connecting walls 54,54 are bent inwardly about the score lines 82,82 and 84,84 until the side walls 52,52 are generally parallel to each other and the longer connecting wall 56 extends generally perpendicular to the side walls.

Referring back to FIG. 5 of the drawing, a yoke member 66 usable in practicing a method in accordance with this invention can be seen. The yoke member 66 is generally U-shaped and includes a central strap 68 connecting a pair of depending parallel legs 70,70 each of which is generally U-shaped to fit over the top edge of the side walls 52,52 of the form 18. Accordingly, the length of the central strap 68 is equal to the distance between the parallel side walls 52,52 of the form 18 so that the strap spans this distance. The central strap 68 is formed with an elongated slot 71 adapted to receive at least one bushing 73 which, in turn, receive the anchor bolts 21 therein so that the anchor bolt extend above the top of the form 18. In practice it may be preferrable to suspend a plurality of anchor bolts from the yoke 66.

In practicing a method in accordance with this invention, after the trench 10 including the enlarged portions 12 has been dug and the footings 14 have been poured and have hardened, generally conventional eyelets 88 or buckle assemblies are driven into each corner of each footing. Thereafter, the grade beams are placed on the footings 14 with each end of each beam bearing on an adjacent footing. That is, the corner beams **16*b* and 16*c* are placed in interlocking engagement and these beams and the intermediate beams 16*a* are placed with their end walls in abutting relationship so that the channels 40 form the keyway. Since the trucks on which the grade beams are shipped to the building site are usually equipped with a small hoist mechanism for loading and unloading the truck, the hoist mechanism can conveniently be used to set the individual grade beams in place. After each grade beam is placed on adjacent footings 14,14 a nylon strap 90 is placed over the beam, as illustrated in FIG. 5 of the drawing, and the ends of the strap are secured to the eyelets 88 and tightened to retain the grade beams in an upright position. A suitable fastener 92 can be driven through the top of the strap 90 and into the top surface 22 of the associated beam. A suitable expansion material 94, for example, the polystyrene used for the insulation in the beam is now inserted in the channels 40 and 46 and around the rib 50. At this point, the forms 18 are folded into the configuration illustrated in FIG. 5 of the drawing and are placed on the footings 14 so that the inside of the form communicates with the keyway formed by the channels 40,40. The studs 59 are driven through the flaps 58,58,58 to retain the bottom edge of the form on the top surface of the footing 14. The L-shaped metal washers 64 can be placed on the flaps 58 prior to driving the studs 59. The L-shaped metal washers 64 are placed in registry with the holes 62*a*, 62*b*, 62*c* and 62*d* with one leg bearing on the outer surface of the side walls 52 and as each washer is placed in registry with the holes, the thread-forming fasteners 65 are driven through the openings into the inner surface 26 and the rib 47 formed in adjacent grade beams to secure the form to the grade beams. Some of the forms 18 are located so that the inside of the form communicates with the keyway slot 50 in grade beams 16*b* and are similarly secured to the footing and grade beam 16*b*. The legs 70,70 of the yoke member 66 are now placed on the top edges of the side walls 52,52 of the form 18 with the strap 68 spanning the side walls. An anchor bolt 21 is placed in a bushing 73 and a nut 75 is threaded on the shank of the anchor bolt such that a suitable portion of the shank extends beyond the nut. The bushing 73 and anchor bolt 21 are placed in the slot 71 so that the threaded portion of the shank extending beyond the nut extends above the top of the form 18. Any desired number of anchor bolts 21 can be placed in each slot 71. Wet concrete is is now poured into the form 18 and flows into the keyways formed between the channels 40,40 of adjacent grade beams and into the keyway 50 formed adjacent the interlocking configuration in the corner beams 16*b*. When the concrete hardens, it forms the piers 20 and the grade beams are secured to the piers and to the top of the footings 14 so that the nylon straps 90 can be removed. Since the forms are a light weight disposable material, there is no need to remove the forms and the trench 10 can now be backfilled to the level of the top wall 22 of the grade beams or to any desired level below the top wall. Suitable brackets (not shown) can now be secured to the outer surfaces 28 of the grade beams for use in securing the side walls of the building to the grade beams. A concrete floor can be formed within the perimeter of the grade beams and suitable anchor bolts can be used to tie the grade beams to the concrete floor. Support columns can be secured to the top of the piers 20 by using suitable anchor plates and the anchor bolts 21**.

It is noted that the bracket assemblies used to secure the side walls to the grade beams can be fixed in place when the grade beams are formed by merely inserting the brackets into the wet concrete forming the outer surface 28 of the beam. Thus, when the concrete hardens the bracket is fixed in the beam. Similarly, the expansion joint material 94 can be set into the form before spraying the concrete so that the expansion joint material is integrally formed with the grade beam.

From the preceding description, it can be appreciated that the grade beams are relatively light weight and can be manipulated without the use of the expensive cranes required by conventional precast foundation walls. It can also be appreciated that utilization of the cardboard disposable forms is also economical in that the usual wood forms need not be built when constructing the foundation. It should also be appreciated that since the amount of concrete poured at the job site is confined to small areas, the effect of inclement weather need not delay the construction of the foundation. The relatively small footings 14 and piers 20 can be poured and covered with suitable straw or insulation material protecting the wet concrete in the event of rain. It can also be appreciated that once the foundation is in place, the walls and roof of the building can be erected and space heaters can be provided in the building to thaw the ground and allow the pouring of the floor without regard to cold or inclement weather.

While in the foregoing there has been disclosed a preferred embodiment of the invention, it should be obvious to those skilled in the art that various changes and modifications can be made without departing from the true spirit and scope of the invention as recited in the appended claims.

I claim:

1. A method of constructing a foundation for a pre-engineered building, the method comprising:

providing footings at spaced-apart locations along a perimeter corresponding to the perimeter of the building to be erected;

setting light weight precast reinforced concrete grade beams between said footings with the ends of each grade beam bearing on adjacent footings;

positioning a light weight generally U-shaped form having a pair of parallel legs, a transverse leg and flap means on each footing and securing said flap means to at least one grade beam and its associated footing whereby said form is secured to at least one grade beam and said associated footing;

placing a yoke across the top of each form and suspending an anchor bolt in each yoke so that a portion of said anchor bolt extends into said form and a threaded portion of said bolt extends above said form; and placing wet concrete into each of said forms to provide a pier securing said grade beam on said associated footing when said concrete hardens.

2. A method in accordance with claim 1 wherein at least one end of each of said grade beams is formed with a channel configuration and wherein at least some of said grade beams are set on said footings such that a keyway is formed between adjacent ends of said some of said grade beams, said forms being positioned on and secured to said footings on which said some of said grade beams are set such that the free ends of said forms are on each side of said keyways so that said wet concrete flows into said keyways.

3. A method in accordance with claim 2 wherein other of said grade beams are set on said footings at a right angle to each other and are interlocked with each other, one of said other of said grade beams being formed with a keyway slot, said forms being positioned on and secured to said footings on which said other of said grade beams are set such that the free ends of said forms are on each side of said keyway slots so that said wet concrete flows into said keyway slots.

4. A method in accordance with claim 1 wherein some of said grade beams are set on said footings at a right angle to each other and are interlocked with each other, one of said some of said grade beams being formed with a keyway slot, said forms being positioned on and secured to said footings on which said some of said grade beams are set such that the free ends of said forms are on each side of said keyway slots so that said wet concrete flows into said keyway slots.

5. A method in accordance with claim 1 further comprising the step of providing temporary supports at the ends of said grade beams after said grade beams are set in place.

6. A method in accordance with claim 1 wherein said forms are cardboard having the strength to withstand 450 psi against its lower edge adjacent said footings.

7. A method in accordance with claim 1 wherein said yoke is formed of a disposable material and includes a slot, said yoke being placed on said form with said slot spanning opposite walls of said form.

8. A foundation of pre-engineered buildings comprising:

footings at spaced-apart locations along a perimeter corresponding to the perimeter of the building to be erected;

light weight precast reinforced concrete grade beams extending between adjacent footings with the ends of each grade beam bearing on adjacent footings whereby adjacent grade beams each have one end on the same footing;

a generally U-shaped form made of light weight material on each footing, each of said forms including a pair of generally parallel side walls and a connecting wall, the free ends of said side walls being formed with flap means for securing said forms to said grade beams and the bottom edges of at least some of said walls being formed with flap means for securing said forms to said footings, fastener means securing each of said forms to their associated footings and to at least one of said grade beams on said associated footings;

a concrete pier in each of said forms secured to said footing and securing said grade beams in an upright position; and an anchor bolt embedded in said concrete pier including a threaded portion extending above said pier for retaining a frame member on said pier.

9. A foundation in accordance with claim 8 including a yoke of disposable material extending across the top of each of said forms for retaining said anchor bolts in position before said concrete piers are formed.

10. A foundation in accordance with claim 8 wherein at least one end of each of said grade beams is formed with a channel configuration, at least some of said grade beams extending in a straight line relative to each other with adjacent ends of said some of said grade beams including said channel configuration whereby a keyway is formed, said forms being positioned such that said concrete piers in said forms extend into said keyway.

11. A foundation in accordance with claim 10 wherein other of said grade beams extend at a right angle to each other, said other of said grade beams being interlocked with each other, and one of said other of said grade beams being formed with a keyway slot, said forms being positioned such that said concrete piers in said forms extend into said keyway slots.

12. A foundation in accordance with claim 8 wherein some of said grade beams extend at a right angle to each other, said some of said grade beams being interlocked with each other, and one of said some of said grade beams being formed with a keyway slot, said forms being positioned such that said concrete piers in said forms extend into said keyway slots.

13. A foundation in accordance with claim 8 wherein said grade beams include exterior walls and internal stiffener walls defining cavities therein, said walls being formed of glass fiber reinforced concrete and said cavities being filled with a light weight insulation material.

14. A foundation in accordance with claim 8 wherein said forms are made of cardboard having a strength to withstand about 450 psi.

15. A grade beam comprising exterior walls including generally parallel top and bottom walls and generally parallel inner and outer walls, said exterior walls forming a closed generally hollow structure, internal stiffener walls formed within said generally hollow structure, said exterior walls and said internal stiffener walls forming a plurality of separate cavities within said generally hollow structure, said exterior walls and said internal stiffener walls being made of concrete reinforced with glass fiber rovings and said cavities being filled with a light weight insulation material, said exterior walls including a pair of end walls located at opposite ends of said generally hollow structure, at least one of said end walls being formed with a channel configuration, a pair of ribs formed on said inner wall, each of said ribs being adjacent an end wall and extending from said top wall to said bottom wall.

16. A grade beam in accordance with claim 15 wherein both of said end walls are formed with said channel configuration.

17. A grade beam in accordance with claim 15 wherein the other of said end walls is formed with interlocking means for interlocking engagement with another grade beam.

18. A grade beam in accordance with claim 15 wherein an interlocking means is formed adjacent the other of said end walls and wherein a keyway is formed adjacent said interlocking means.

19. A grade beam in accordance with claim 15 wherein said channel is formed by a pair of generally parallel walls and a connecting wall, one of said pair of parallel channel walls being shorter than the other.

20. A grade beam in accordance with claim 19 wherein said ribs are formed adjacent said shorter one of said pair of generally parallel channel walls.

21. A grade beam in accordance with claim 15 wherein said internal stiffener walls include first walls extending generally parallel to said top and bottom walls and second walls extending generally parallel to said end walls.

22. A grade beam in accordance with claim 15 wherein said insulation material is polystyrene.

23. A method of constructing a foundation for a pre-engineered building, the method comprising:

providing footings at spaced-apart locations along a perimeter corresponding to the perimeter of the building to be erected;

setting light weight precast reinforced concrete grade beams between said footings with the ends of each grade beam bearing on adjacent footings;

at least one end of each of said grade beams being formed with a channel configuration and wherein at least some of said beams are set on said footings such that a keyway is formed between adjacent ends of said some of said grade beams, other of said grade beams being set on said footing at a right angle to each other and being interlocked with each other, one of said other of said grade beams being formed with a keyway slot;

positioning a generally U-shaped form made of light weight material on each footing and securing said forms to their associated footing and to at least one grade beam on said associated footing;

some of said forms being positioned on and secured to said footings on which said some of said grade beams are set such that the free ends of said forms are on each side of said keyways so that wet concrete can flow into said keyways, other of said forms being positioned on and secured to said footings on which said other of said grade beams are set such that the free ends of said forms are on each side of said keyway slots so that wet concrete can flow into said keyway slots;

placing a yoke across the top of each form and suspending an anchor bolt in each yoke so that a portion of said anchor bolt extends above said form; and placing wet concrete into each of said forms to provide a pier securing said grade beam on said associated footing when said concrete hardens.

24. A method of constructing a foundation for a pre-engineered building, the method comprising;

providing footings at spaced-apart locations along a perimeter corresponding to the perimeter of the building to be erected;

setting light weight precast reinforced concrete grade beams between said footings with the ends of each grade beam bearing on adjacent footings;

some of said grade beams being set on said footings at a right angle to each other and being interlocked with each other, one of said some of said grade beams being formed with a keyway slot;

positioning a generally U-shaped form made of light weight material on each footing and securing said forms to their associated footing and to at least one grade beam on said associated footing;

said forms being positioned on and secured to said footings on which said some of said grade beams are set such that the free ends of said forms are on each side of said keyway slots so that wet concrete can flow into said keyway slots;

placing a yoke across the top of each form and suspending an anchor bolt in each yoke so that a portion of said anchor bolt extends into said form and a threaded portion of said bolt extends above said form; and placing wet concrete into each of said forms to provide a pier securing said grade beam on said associated footing when said concrete hardens.

25. A foundation of pre-engineered buildings comprising:

footings at spaced-apart locations along a perimeter corresponding to the perimeter of the building to be erected;

light weight precast reinforced concrete grade beams extending between adjacent footings with the ends of each grade beam bearing on adjacent footings whereby adjacent grade beams each have one end on the same footing;

a generally U-shaped form made of light weight material on each footing, said forms being secured to their associated footing and to at least one of said grade beams on said associated footing;

a concrete pier in each of said forms secured to said footing and securing said grade beams in an upright position;

an anchor bolt embedded in said concrete pier including a threaded portion extending above said pier for retaining a framing member on said pier;

at least one end of each of said grade beams being formed with a channel configuration, at least some of said grade beams extending in a straight line relative to each other with adjacent ends of said some of said grade beams including said channel configuration whereby a keyway is formed, said forms being positioned such that said concrete piers in said forms extend into said keyway, other of said grade beams extending at a right angle to each other, said other of said grade beams being interlocked with each other, and one of said other of said grade beams being formed with a keyway slot, said forms being positioned such that said concrete piers in said forms extend into said keyway slots.

26. A foundation of pre-engineered buildings comprising:

footings at spaced-apart locations along a perimeter corresponding to the perimeter of the building to be erected;

light weight precast reinforced concrete grade beams extending between adjacent footings with the ends of each grade beam bearing on adjacent footings whereby adjacent grade beams each have one end on the same footing;

a concrete pier in each of said forms secured to said footing and securing said grade beams in an upright position; and an anchor bolt embedded in said concrete pier including a threaded portion extending above said pier for retaining a framing member on said pier; some of said grade beams extending at a right angle to each other, said some of said grade beams being interlocked with each other, and one of said some of said grade beams being formed with a keyway slot, said forms being positioned such that said concrete piers in said forms extend into said keyway slots.

27. A foundation of pre-engineered buildings comprising:

footings at spaced-apart locations along a perimeter corresponding to the perimeter of the building to be erected;

light weight precast reinforced concrete grade beams extending between adjacent footings with the ends of each grade beam bearing on adjacent footings whereby adjacent grade beams each have one end on the same footing;

a generally U-shaped form made of light weight material on each footing, said forms being secured to their associated footing and to at least one of said grade beams on said associated footing; a concrete pier in each of said forms secured to said footing and securing said grade beams in an upright position; and an anchor bolt embedded in said concrete pier including a threaded portion extending above said pier for retaining a framing member on said pier; said forms being made of cardboard having a strength to withstand about 450 psi and including a pair of generally parallel side walls and a connecting wall, the free ends of said side walls being formed with flaps for securing said form to said grade beams, the bottom edges of said walls and said connecting wall being formed with flaps for securing said forms to said footings.

* * * * *